US007846113B2

(12) United States Patent
Ferber et al.

(10) Patent No.: US 7,846,113 B2
(45) Date of Patent: Dec. 7, 2010

(54) BODY MASSAGE APPARATUS

(75) Inventors: Roman Ferber, West Bloomfield, MI (US); Shianp Jyh Chung, Taipei (TW); Wenjing Li, Shenzhen (CN)

(73) Assignee: FKA Distributing Co., Commerce Township, MI (US)

( * ) Notice: Subject to any disclaimer, the term of this patent is extended or adjusted under 35 U.S.C. 154(b) by 1131 days.

(21) Appl. No.: 11/460,442

(22) Filed: Jul. 27, 2006

(65) Prior Publication Data

US 2007/0027412 A1 Feb. 1, 2007

(30) Foreign Application Priority Data

Jul. 28, 2005 (CN) ..... 2005 2 0114378

(51) Int. Cl.
*A61H 7/00* (2006.01)

(52) U.S. Cl. ..... 601/94; 601/90; 601/93

(58) Field of Classification Search ..... 601/84–87, 601/89, 90–94, 97, 98, 101, 103, 112, 113
See application file for complete search history.

(56) References Cited

U.S. PATENT DOCUMENTS

| | | | | |
|---|---|---|---|---|
| 3,374,784 | A | 3/1968 | Brent et al. | |
| 4,718,408 | A | 1/1988 | Barreiro | |
| 5,356,369 | A | 10/1994 | Yamasaki et al. | |
| 5,685,827 | A | 11/1997 | Shimizu | |
| 5,785,668 | A | 7/1998 | Shimizu | |
| 6,629,940 | B2 | 10/2003 | Shimizu | |
| 7,128,721 | B2 | 10/2006 | Ferber et al. | |
| 7,179,240 | B2 | 2/2007 | Wu | |
| 7,294,113 | B1 | 11/2007 | Wu | |
| 2003/0009117 | A1 | 1/2003 | Zou | |
| 2003/0060741 | A1 | 3/2003 | Park | |
| 2004/0049136 | A1 * | 3/2004 | Lin | 601/86 |
| 2004/0106882 | A1 | 6/2004 | Tseng | |
| 2005/0124921 | A1 | 6/2005 | Tseng | |
| 2005/0245851 | A1 | 11/2005 | Ferber et al. | |
| 2005/0256434 | A1 | 11/2005 | Luo | |
| 2006/0211962 | A1 | 9/2006 | Ferber et al. | |

FOREIGN PATENT DOCUMENTS

CN 2587403 11/2003

OTHER PUBLICATIONS

HoMedics, Shiatsu Massaging Cushion, Moving Massage Mechanism, SBM-200, Instruction Manual and Warranty Information, 2003-2005 HoMedics, Inc., and Figures from Ferber et al. 7,128,721 B2, 20 pages.

* cited by examiner

*Primary Examiner*—Quang D Thanh
(74) *Attorney, Agent, or Firm*—Brooks Kushman P.C.

(57) ABSTRACT

A massage apparatus is disclosed with a housing and a motor oriented in the housing. An eccentric drive is driven by the motor for oscillating an elongate massage member. In one embodiment a pair of elongate massage members are provided. In another embodiment, a massage formation is limited to a range of linear translation in a first direction and limited to a range of rotational translation relative to the housing.

22 Claims, 10 Drawing Sheets

BODY MASSAGE APPARATUS

CROSS-REFERENCE TO RELATED APPLICATIONS

This application claims priority of CN Patent Application No. 200520114378.0, filed on Jul. 28, 2005, which is incorporated in its entirety by reference herein.

BACKGROUND OF THE INVENTION

1. Field of the Invention

The present invention relates to portable massage cushions, capable of providing a massage of adjustable speed and orientation.

2. Background Art

In the prior art, a massage chair comprises a chair backrest, left and right armrests, a seat cushion and a foot cushion. Such a massage chair can be used to release fatigue, lumbago and backache from a user, but the massage chair is rather bulky and heavy, which may be difficult to move randomly at will. Therefore, users have to enjoy the massage chair at a fixed place, which is not convenient for use.

Figure 1:
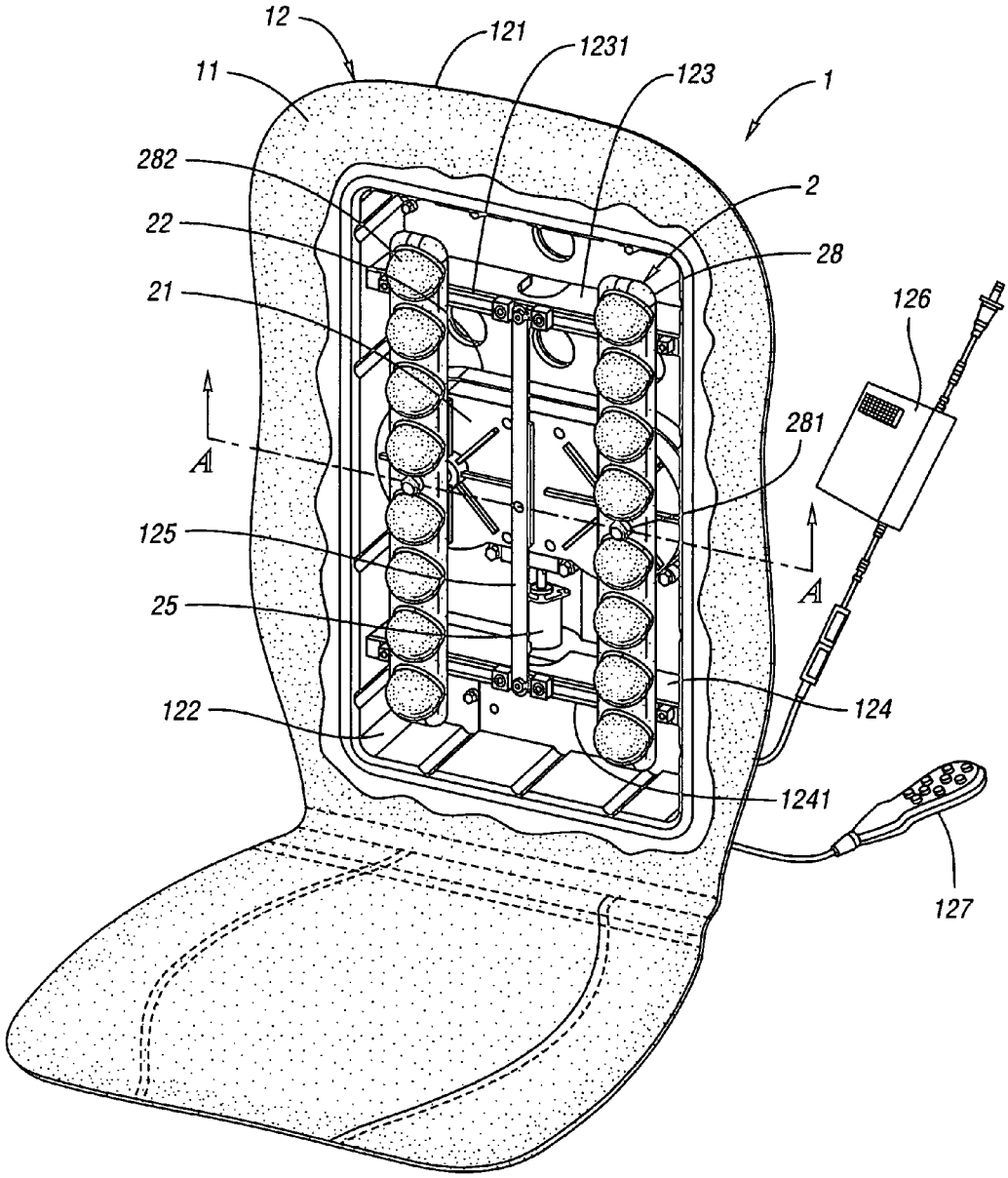
FIG. 1 is a front perspective view of a body massage apparatus according to the present invention.

1—seat cushion
11—fabric cover
111—fabric flap
112—sponge body
12—seat cushion back
121—body
1211—upper cushion
1212—lower cushion
1213—springs
122—supporting frame
123—upper cross support
1231—upper rail
1232—upper aperture
1233—upper padding block

124—lower cross support
1241—lower rail
1242—lower aperture
1243—lower padding block
125—longitudinal support
126—power cord
127—controller
2—massage mechanism
21—front gear cover
22—back gear cover
23—worm gear
24—screw
25—driving motor
251—rotary output shaft
26—transmission shaft
261—first axis
27—eccentric rotating block
271—bore
272—bolt
273—gasket
274—retaining ring
275—second axis
28—massage member
281—bore
282—massage head
3—massage mechanism
31—slide block
4—seat cushion back
41—body
42—supporting frame
43—upper massage mechanism
44—lower massage mechanism
45—motor
46—shaft
461—second shaft
47—gear cover
48—massage member
481—bore
482—massage node

DESCRIPTION OF EMBODIMENTS OF THE INVENTION

As required, detailed embodiments of the present invention are disclosed herein; however, it is to be understood that the disclosed embodiments are merely exemplary of the invention that may be embodied in various and alternative forms. The Figures are not necessarily to scale; some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

As shown in FIGS. 1-4, a portable body massage apparatus is illustrated embodied as a massage cushion, such as a seat cushion 1 with a massage mechanism 2 disposed within a portion of the seat cushion 1. Although various body massage apparatuses are contemplated within the spirit and scope of the present invention, the seat cushion 1 of the embodiment of FIGS. 1-4 is illustrated as being sized to rest upon a conventional chair.

The seat cushion 1 may include an L-shaped fabric cover 11 and a seat cushion back 12. A fabric flap 111 (FIG. 2) may be disposed on a front side of the fabric cover 11 for damping a force on a user by the massage mechanism 2. The fabric cover 11 and the fabric flap 111 may each be formed by cloth or any suitable fabric. A sponge body 112 may be attached to a bottom portion of the fabric cover 11 for providing comfort to the user when sitting upon the fabric cover 11.

The seat cushion back 12, in one embodiment, includes a concave body 121 with a supporting frame 122 provided within the concave region of the concave body 121, which provides a housing for the massage device 2.

An upper cross support 123 may be provided within the body 121 at an upper position of the supporting frame 122. An upper rail 1231 may be disposed along a front surface of the upper cross support 123. The upper rail 1231 may be provided with a plurality of upper apertures 1232. An upper padding block 1233 may be provided and fastened to each of the upper apertures 1232. Likewise, a lower cross support 124 may be disposed within the body 121 at a lower position of the supporting frame 122. A lower rail 1241 may be disposed on a front surface of the lower cross support 124. The lower rail 1241 may be provided with a plurality of lower apertures 1242. A lower padding block 1243 may be provided for each of the lower apertures 1242. Furthermore, a longitudinal support 125 may be disposed within the body 121 between the upper rail 1231 and the lower rail 1241 for fixing a front gear cover 21 of the massage mechanism 2 in position within the frame 122.

To enhance comfort to the user, an upper cushion 1211 may be provided within the frame 122 above the upper cross support 123. Additionally, a lower cushion 1212 may be provided beneath the lower cross support 124 between the frame 122. The upper and lower cushions 1211, 1212 may be biased forward by a plurality of springs 1213 disposed beneath the cushions 1211, 1212 and engaging the frame 122 within the body 121.

The body 121 may also be provided with a power cord 126 for providing power to the massage mechanism 2. Additionally, a controller 127 may be attached to the body 121 in cooperation with the massage mechanism 2 for permitting the user to control the operation of the massage mechanism 2.

In one embodiment, the massage mechanism 2 includes a gear cover constructed by the front gear cover 21 and a back gear cover 22. The back gear cover 22 may be formed integrally with the frame 122. A pair of worm gears 23 are installed within the gear cover at lateral orientations, such as a right and a left side of the gear cover. A worm drive, such as a screw 24 may be provided between the worm gears 23. The screw 24 may be mounted to a rotary output shaft 251 of a driving motor 25 that is mounted within the body 121. The motor 25 drives the rotary output shaft 251 with the screw 24 mounted to the shaft 251 for imparting rotation to the worm gears 23.

A pair of transmission shafts 26 are provided, each disposed along a first axis 261 of one of the worm gears 23. Each transmission shaft 26 is coupled for rotation with one of the worm gears 23, for being driven by the respective worm gear 23. Each transmission shaft 26 passes through the front gear cover 21. A pair of eccentric rotating blocks 27 are provided, each with a bore 271 mounted upon the end of one of the transmission shafts 26 extending through the front gear cover 21. Each eccentric rotating block 27 is provided with a bolt 272 extending from the block 27. Each bolt 272 is radially offset from the respective bore 271 and generally parallel with the respective bore 271.

A pair of massage columns or elongate massage members 28 are each equipped with a plurality of hemispherical or ball-shaped massage nodes or heads 282 for imparting a massage effect upon the user. Each massage member 28 is provided with a bore 281, which receives one of the bolts 272 of one of the eccentric rotating blocks 27, so that both of the elongate massage member 28 can be driven by the worm gears 23 through the transmission shafts 26 and the eccentric rotating blocks 27.

During assembly, the supporting frame 122 may be installed inside the concave cushion body 121 of the seat cushion back 12. The back gear cover 22 may be placed in the supporting frame 122. The worm gears 23 may be disposed respectively at the right and left lateral sides within the back gear cover 22. Then, the front gear cover 21 may be coupled to the back gear cover 22. The screw 24 may be disposed between the worm gears 23; and the driving motor 25 may be attached with the screw 24 and placed below the worm gears 23. Then, the transmission shafts 26 may be disposed along the axis of each of the worm gears 23, thereby passing through the front gear cover 21. The eccentric rotating blocks 27 may each be attached at an end of one of the transmission shafts 26. Then, the bolts 272 may each be fixed on one of the eccentric rotating blocks 27. The bore 281 of the elongate massage member 28 may each be placed over one of the bolts 272. Each elongate massage member 28 may be fixed to the corresponding bolt 272 by a gasket 273 and a retaining ring 274.

The cross supports 123, 124 may be installed into the frame 122. The upper rail 1231 is disposed on the front of the upper cross support 123. The lower rail 1241 is disposed on the front of the lower cross support 124. One of the upper padding blocks 1233 is mounted to each of the apertures 1232 of the upper rail 1231. Likewise, one of the lower padding blocks 1243 is mounted to each of the apertures 1242 of the lower rail 1241. The longitudinal support 125 is installed between the upper rail 1231 and the lower rail 1241 for fixing the front gear cover 21 in position. The cushions 1211, 1212 and spring 1213 are installed into the frame 122. Subsequently, the L-shaped fabric cover 11 is displaced upon the seat cushion back 12. The fabric flap 111 is displaced on the front of the fabric cover 11. The sponge body 112 is attached at the bottom of the lower region of the fabric cover 11, thereby collectively providing the massage seat cushion 1.

In operation, the fabric flap 111 may be displaced on the front of the fabric cover 11 for obtaining a desired dampened massage effect for the user. The power cord 126 may be connected to a power supply and the user may operate the controller 127 to control a first rotary direction of the motor 25, a reverse rotary rotation of the motor 25, and the rotating speed of the motor 25.

Figure 3:
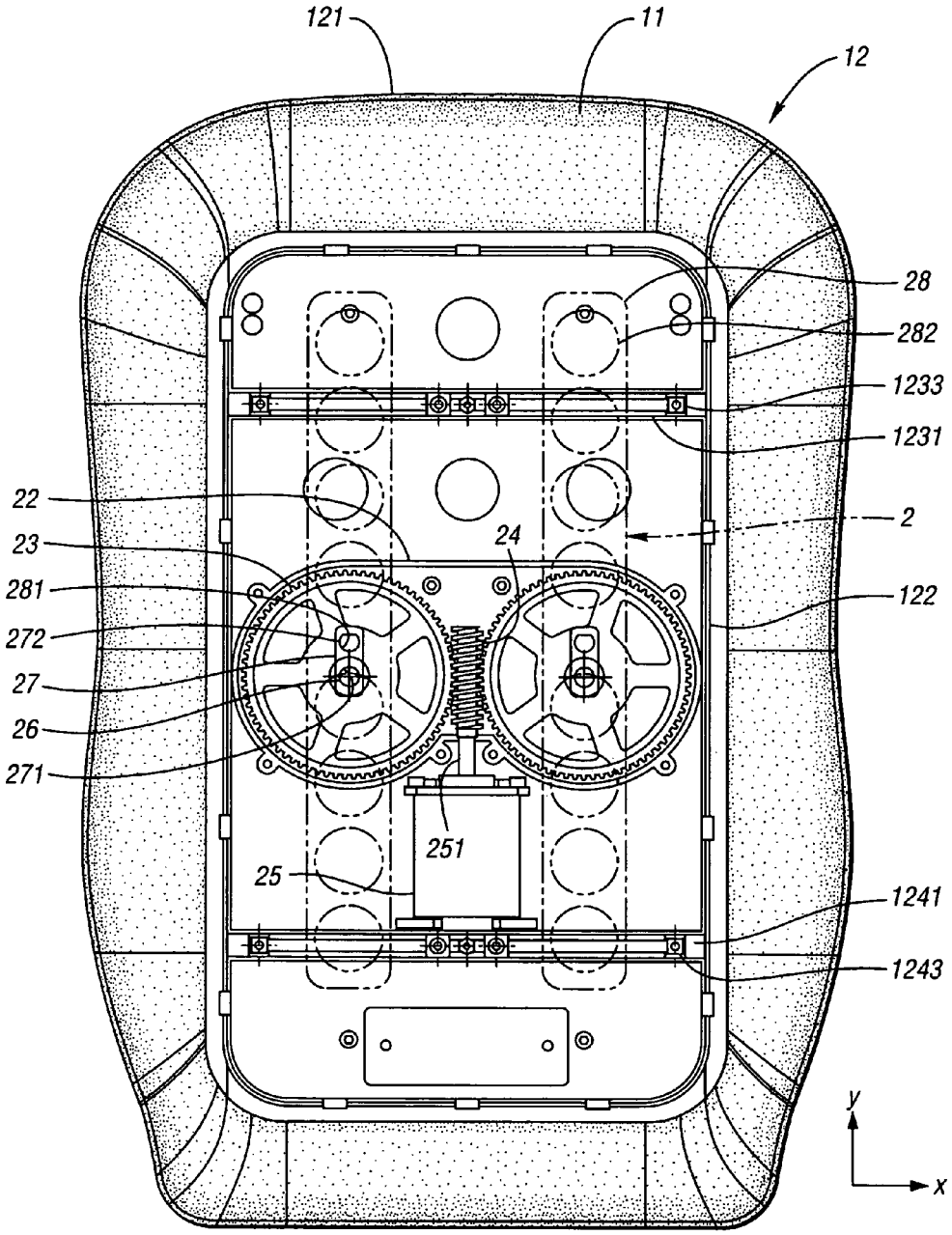
FIG. 3 is a fragmentary front elevation view of the body massage apparatus of FIG. 1.
Figure 4:
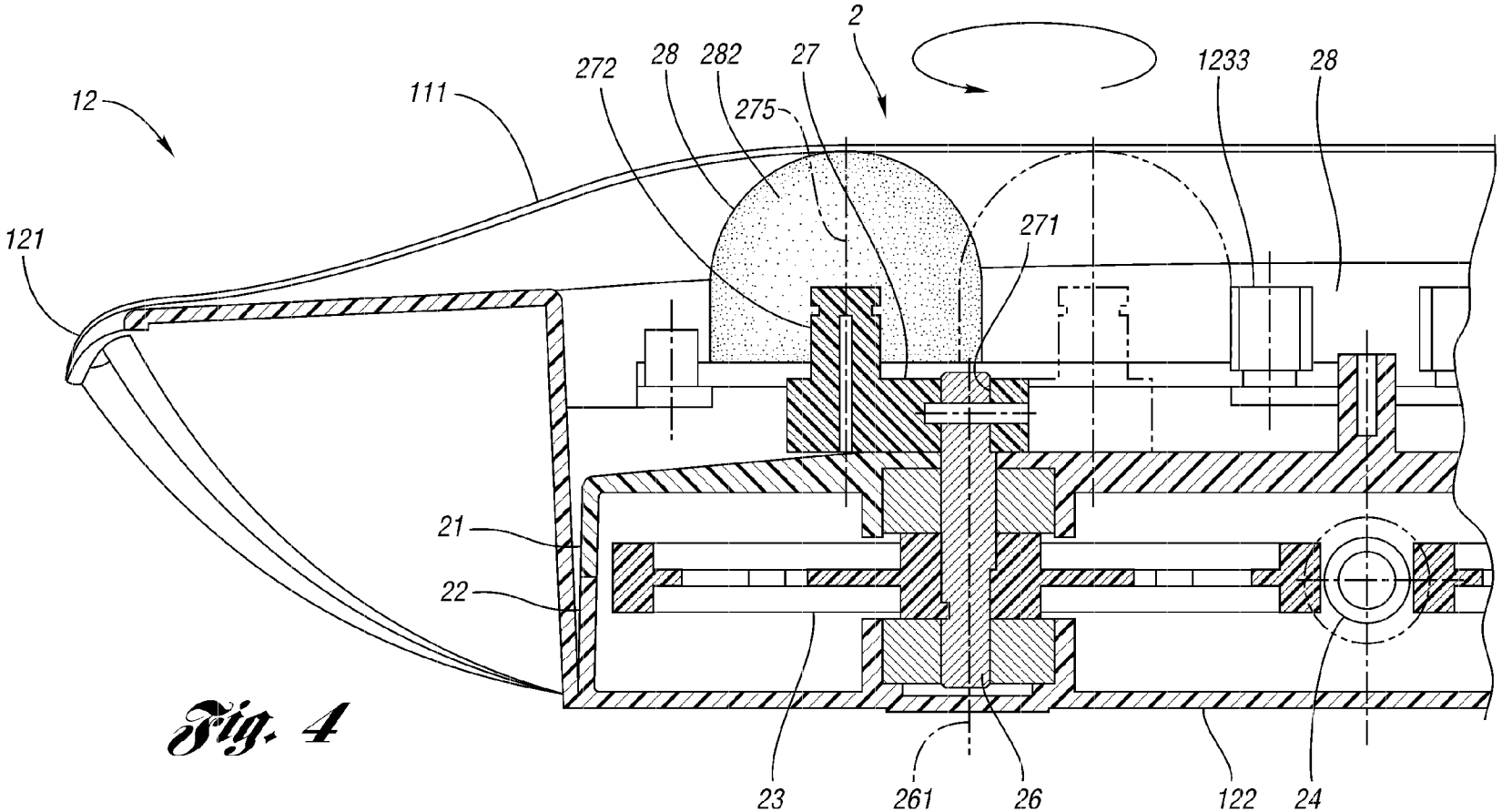
FIG. 4 is a partial section view of the body massage apparatus taken along section line A-A of FIG. 1.

As illustrated in FIG. 3, when the driving motor 25 rotates the rotary output shaft 251, the screw 24 is rotated thereby driving the worm gears 23 for asynchronous rotation. Thus, if the right gear 23 is driven clockwise, then the left gear 23 is driven counterclockwise. The worm gears 23 drive the transmission shafts to thereby drive the eccentric rotating blocks so that each bolt 272 revolves about the corresponding transmission shaft 26 as illustrated by the arcuate arrows in FIG. 3. Thus, as the bolts 272 are driven eccentrically, the massage members 28 and the associated massage heads 282 are driven to oscillate as illustrated in FIG. 4, to impart a massage effect upon the body of the user.

With reference to FIG. 3, each of the massage members 28 is oscillated as the corresponding bolt 272 revolves relative to the corresponding bore 271 of the eccentric rotating block 27. To prevent the massage members 28 from merely rotating with the corresponding transmission shafts 26, the ranges of translation of the elongate massage member 28 are provided with hard stops. For example, limits to the range of translation of the massage members 28 are provided in at least one linear direction of translation of the elongate massage member 28, such as direction x in FIG. 3. Thus, the range of linear translation of each massage member 28 is limited in the x direction by the upper padding block 1233 and the lower padding block 1243 provided on the right lateral side of the massage member 28; and the range is limited in the reverse x direction by the upper padding block 1233 and the lower padding block 1243 provided on the other, left lateral side of the massage member 28. Accordingly, as the massage member 28 is driven by the bolt 272 of the eccentric rotating block 27, the massage member 28 is limited in translation in the x direction, but is not limited in translation in a y direction. By limiting the range of translation of the elongate massage member 28 in the x direction, the rotational translation of the elongate massage member 28 is also limited. Thus, both elongate massage members 28 are generally oscillated within a common plane perpendicular to the respective second axis 275 of rotation for providing a kneading massage effect upon an elongate surface of the body part of the user.

For example, if the user sits upon the seat cushion 1, with the user's back against the seat cushion back 12, the user experiences an asymmetrical kneading massage effect upon the length of the user's back. During operation, a resultant force applied by the user's back upon the elongate massage members 28 may limit the range of translation of the elongate massage members 28 in the x direction, or a range of rotation of the elongate massage members 28 about the bolts 272. Of course, the padding blocks 1233, 1243 provide an appropriate range when the elongate massage members 28 are unaffected by external forces.

Each elongate massage member 28 may include a linear array of massage nodes 282, which may be bisected by the corresponding bolt 272 for providing a uniform massage effect upon the upper and lower regions of the elongate massage member 28.

In order to dampen impacts between the massage members 28 and the padding blocks 1233, 1243, the padding blocks 1233, 1243 may be formed of an elastomeric material. Accordingly, the massage members 28 may each be formed of a material having a sufficient durometer to withstand impacts with the padding blocks 1233, 1243.

Due to the elongate lengths of the massage members 28, the upper rail 1231 and the lower rail 1241 may act as slide supports to the elongate massage members 28 for permitting the elongate massage members 28 to slide upon the upper and lower rails 1231, 1241 while providing a resultant force to the elongate massage members 28 for minimizing strain upon the elongate massage members 28 and for minimizing friction therebetween.

Figure 5A:
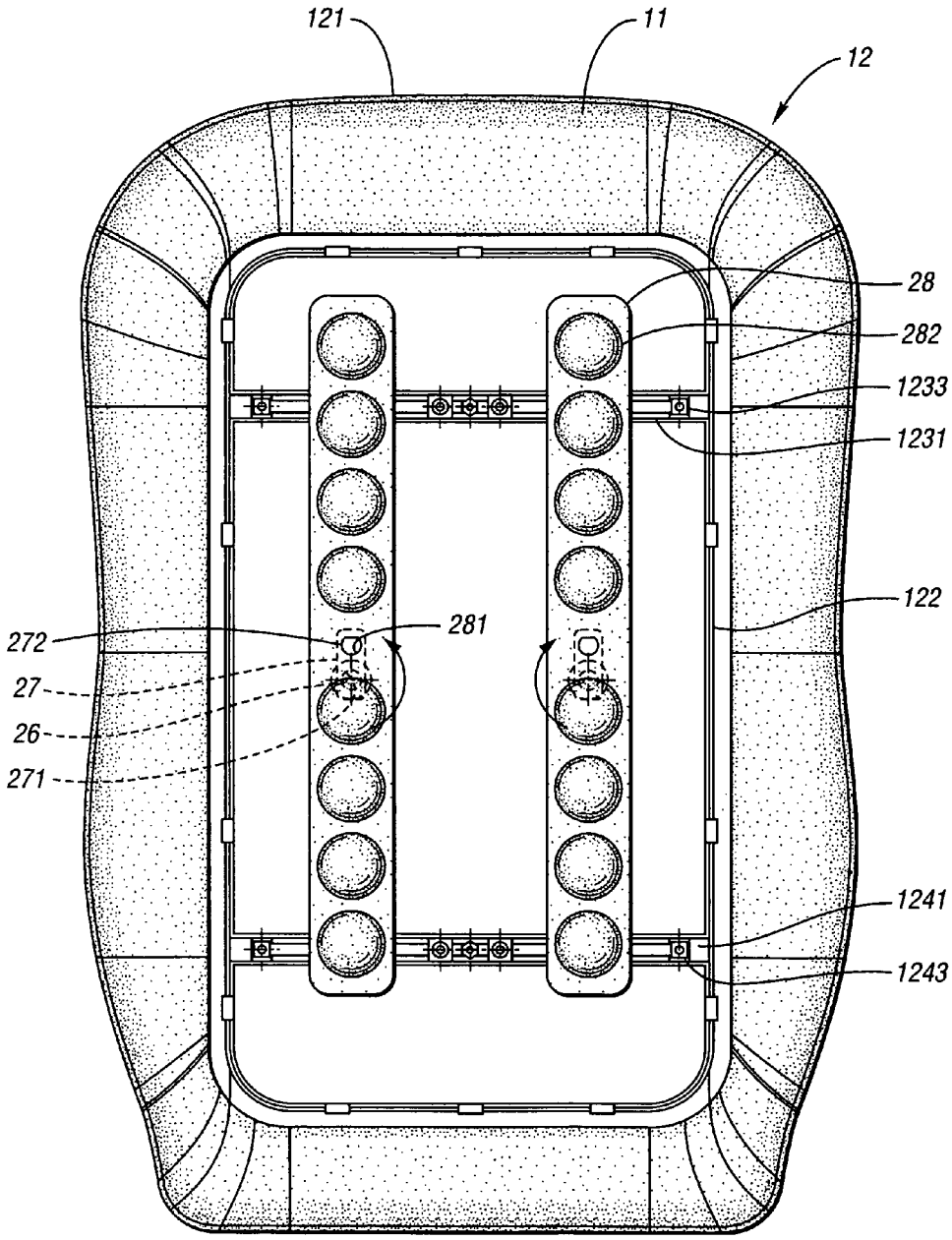
FIG. 5*a* is a front elevation schematic view of the body massage apparatus of FIG. 1, illustrating massage members of the body massage apparatus in a first position.
Figure 5B:
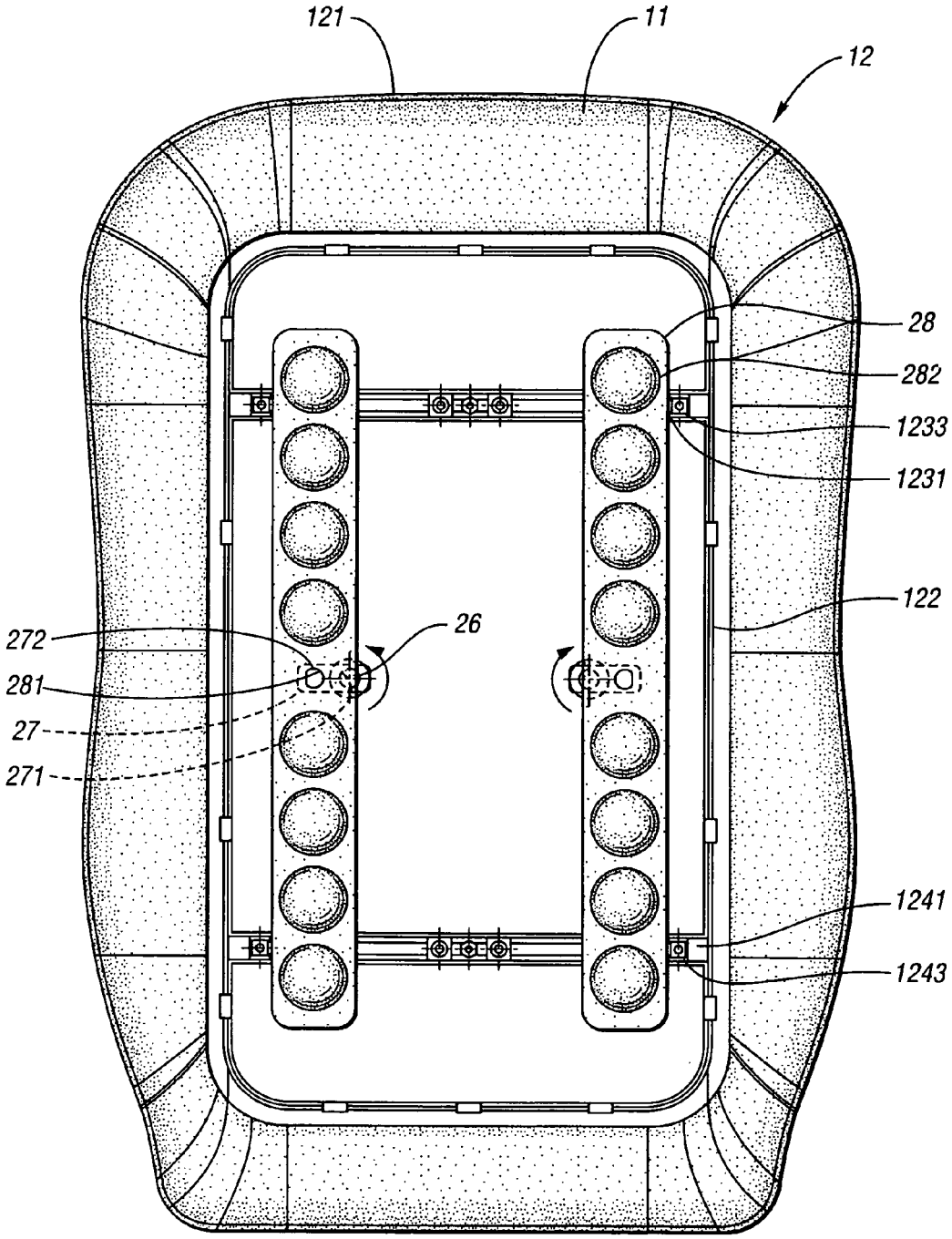
FIG. 5*b* is another front elevation schematic view of the body massage apparatus of FIG. 1, illustrating the massage members in a second position.
Figure 5C:
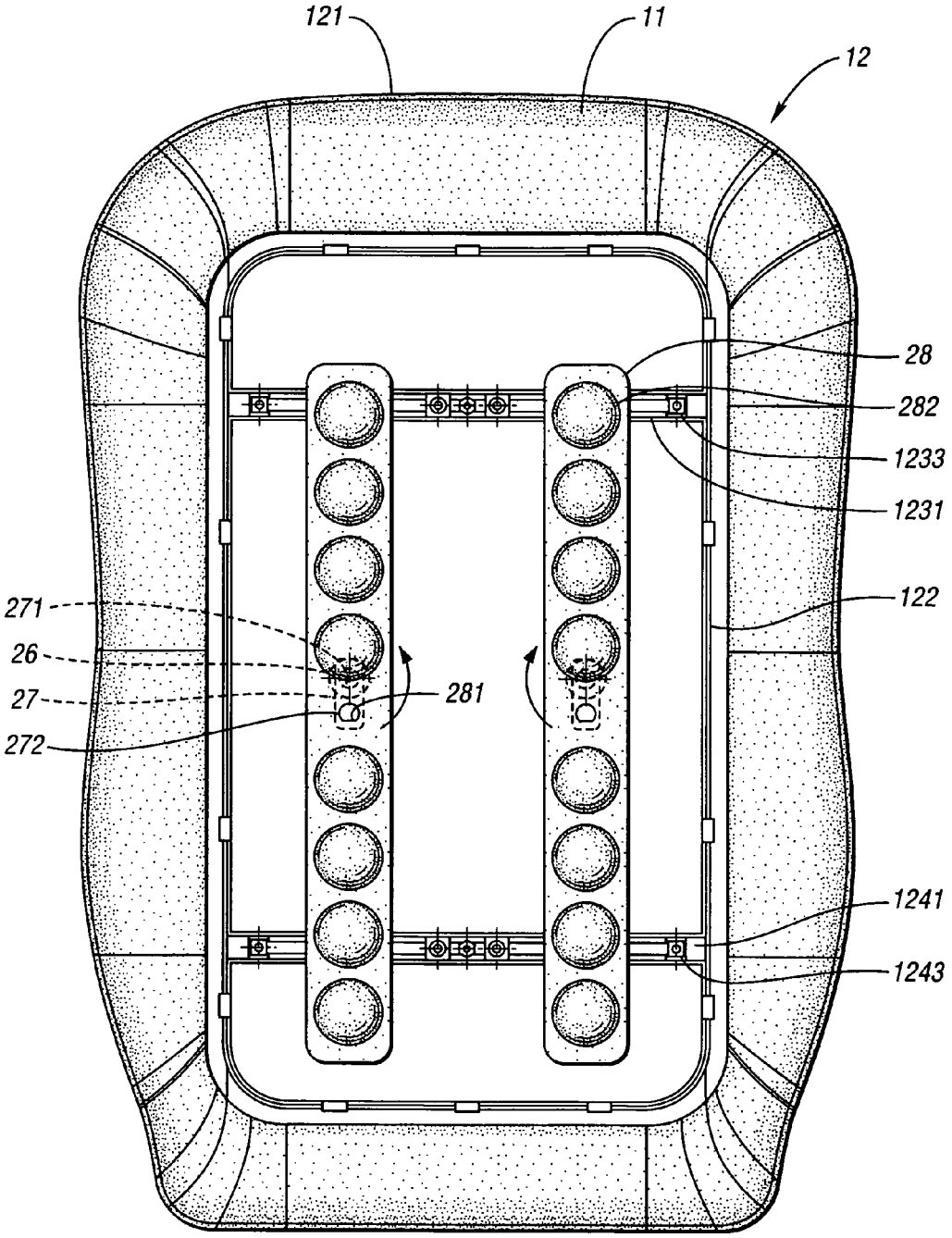
FIG. 5*c* is another front elevation schematic view of the body massage apparatus of FIG. 1, illustrating the massage members in a third position.
Figure 5D:
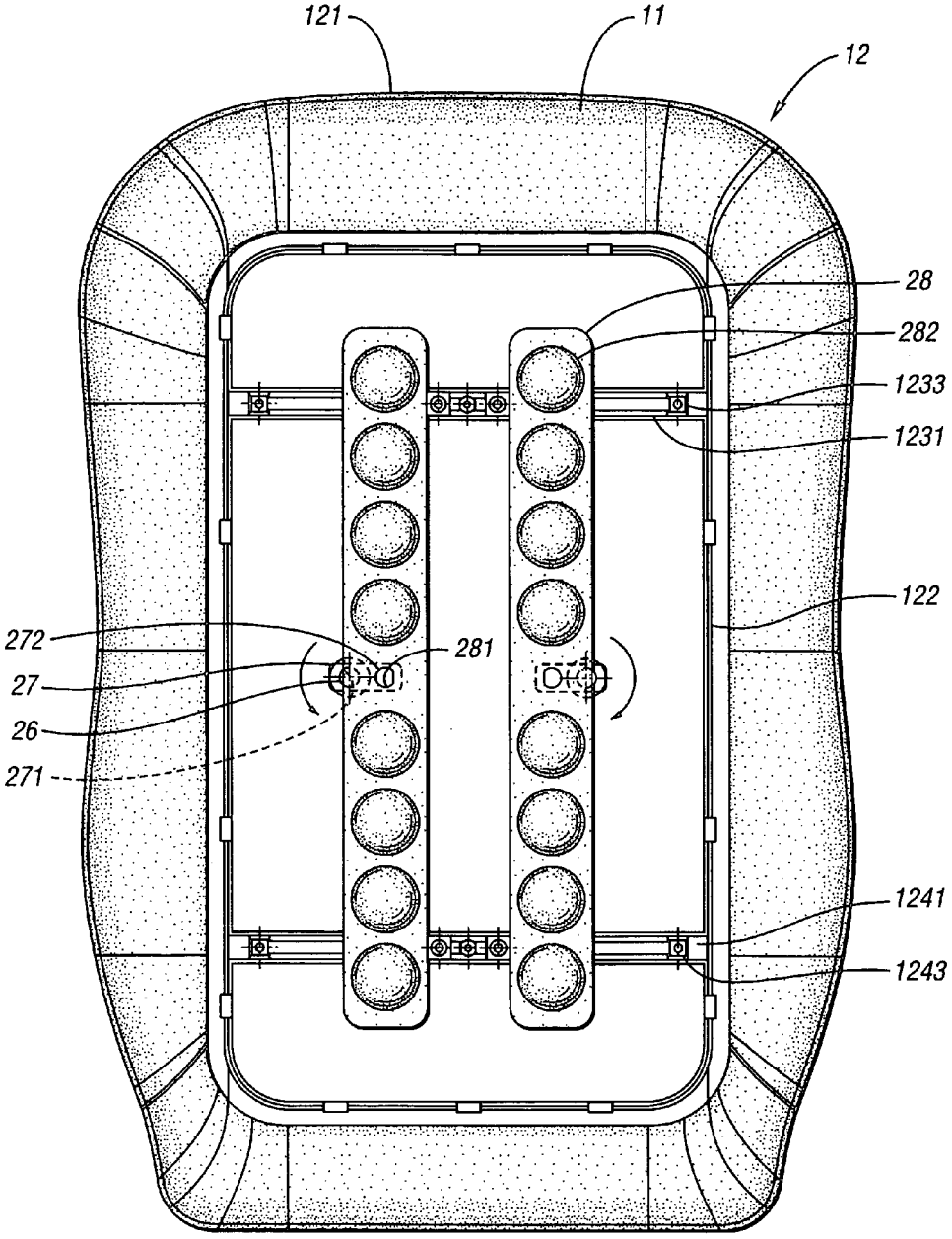
FIG. 5*d* is yet another front elevation schematic view of the body massage apparatus of FIG. 1, illustrating the massage members in a fourth position.

To further illustrate the path of travel of the massage members 28, the massage members 28 are illustrated in multiple positions in FIGS. 5*a*-5*d*. Referring now to FIG. 5*a*, the seat cushion back 12 is illustrated schematically for illustrating an orientation of the massage members 28 relative to the frame 122. In the orientation illustrated in FIG. 5*a*, the eccentric blocks 27 are oriented with the bolts 272 at an uppermost orientation. In one operation of the motor 25, the left eccentric block 27 rotates counterclockwise, while the right eccentric block 27 rotates clockwise as depicted by the arcuate arrows in FIGS. 5*a*-5*d*. Referring now to FIG. 5*b*, the massage members 28 are each translated laterally outboard such that the massage members 28 engage the outboard upper padding blocks 1233 and outboard lower padding blocks 1243. As the eccentric rotating blocks 27 continue to rotate counterclockwise for the left massage member 28, and clockwise for the right massage member 28, the massage members 28 are translated to a lowermost orientation as illustrated in FIG. 5*c*. Subsequently, as the eccentric rotating blocks 27 continue to rotate about the respective transmission shafts 26, the bolts 272 are extended to an inwardmost position as illustrated in FIG. 5*d*, thereby translating the massage members 28 to contact the inboard upper and lower padding blocks 1233, 1243. Accordingly, the eccentric rotating blocks 27 continue to rotate thereby oscillating the massage members 28 relative to the frame 122, while the padding blocks 1233, 1243 limit the lateral translation of the massage members 28.

Of course, the invention contemplates that the massage members 28 may be driven in reverse, for example, driven to translate in the opposite direction of the rotary arrows illustrated in FIGS. 5*a*-5*d* and translated in a sequence from 5*d*-5*a*. Of course, the invention contemplates that the massage members 28 may be driven in common rotating directions, or out of phase.

Figure 6:
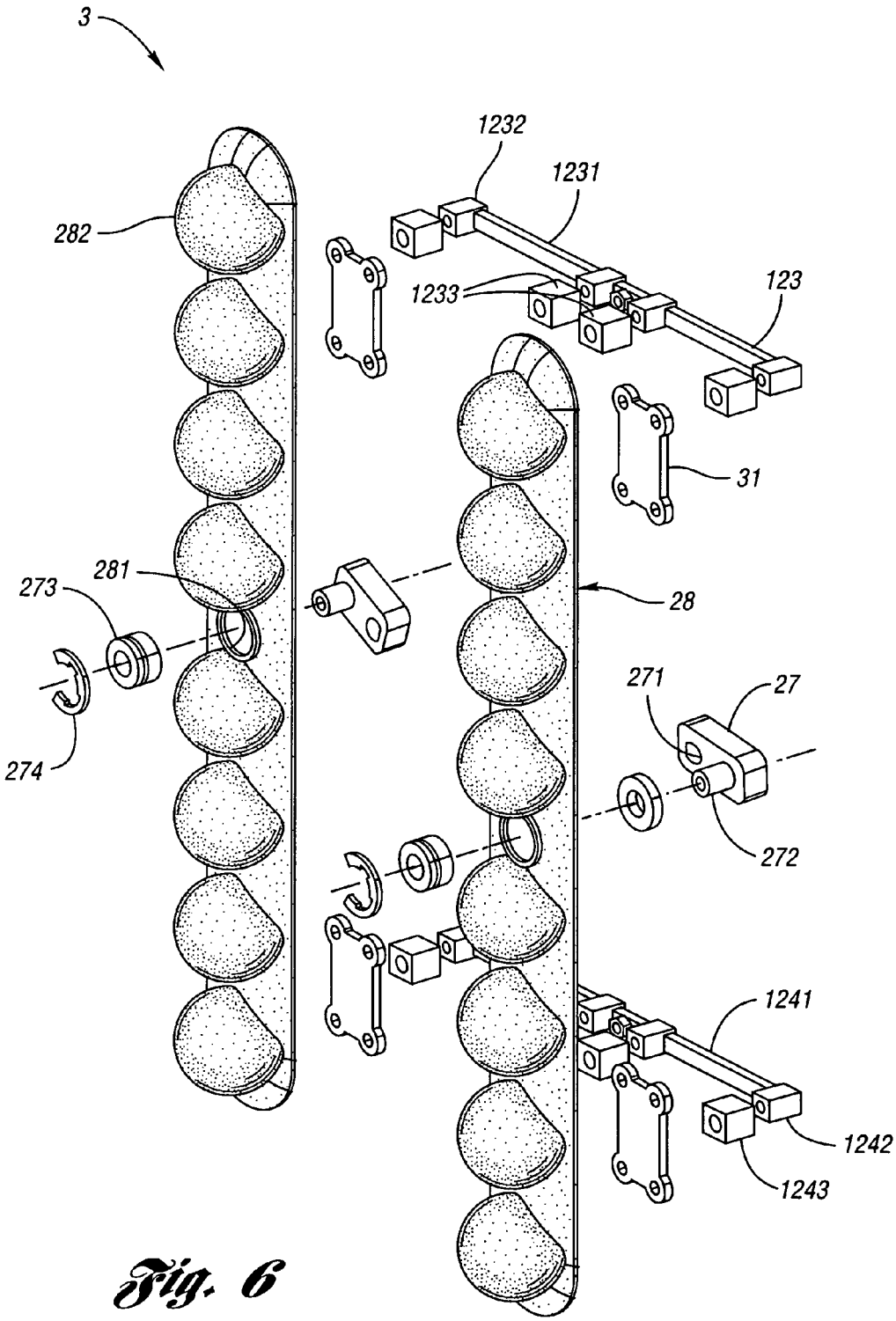
FIG. 6 is an enlarged exploded perspective view of a portion of another body massage apparatus embodiment in accordance with the present invention.

With reference now to FIG. 6, a portion of another embodiment massage mechanism 3 is illustrated in accordance with the present invention. Similar or same elements retain same reference numerals wherein new elements are assigned new reference numerals. Each massage member 28 of the massage mechanism 3 is provided with a pair of slide blocks 31 mounted to the underside thereof and oriented for engaging the upper and lower rails 1231, 1241 for reducing friction between the massage members 28 and the rails 1231, 1241, while reducing wear to the massage members 28. The slide blocks 31 may also have a width that is sufficient for engaging the padding blocks 1233, 1243 so that the slide blocks 31 receive the impact from the padding blocks 1233, 1243 and evenly distribute the impact to the contact members 28 to avoid a focused impact upon the massage members 28.

The invention contemplates that a massage mechanism, such as the massage mechanism 2 in the embodiment of FIGS. 1-5*d*, may be employed to apply a massage effect to a full body portion of the user, such as across a full back of the user. Alternatively, multiple massage mechanisms may be employed for providing targeted massage effects to multiple regions of the user.

Figure 7:
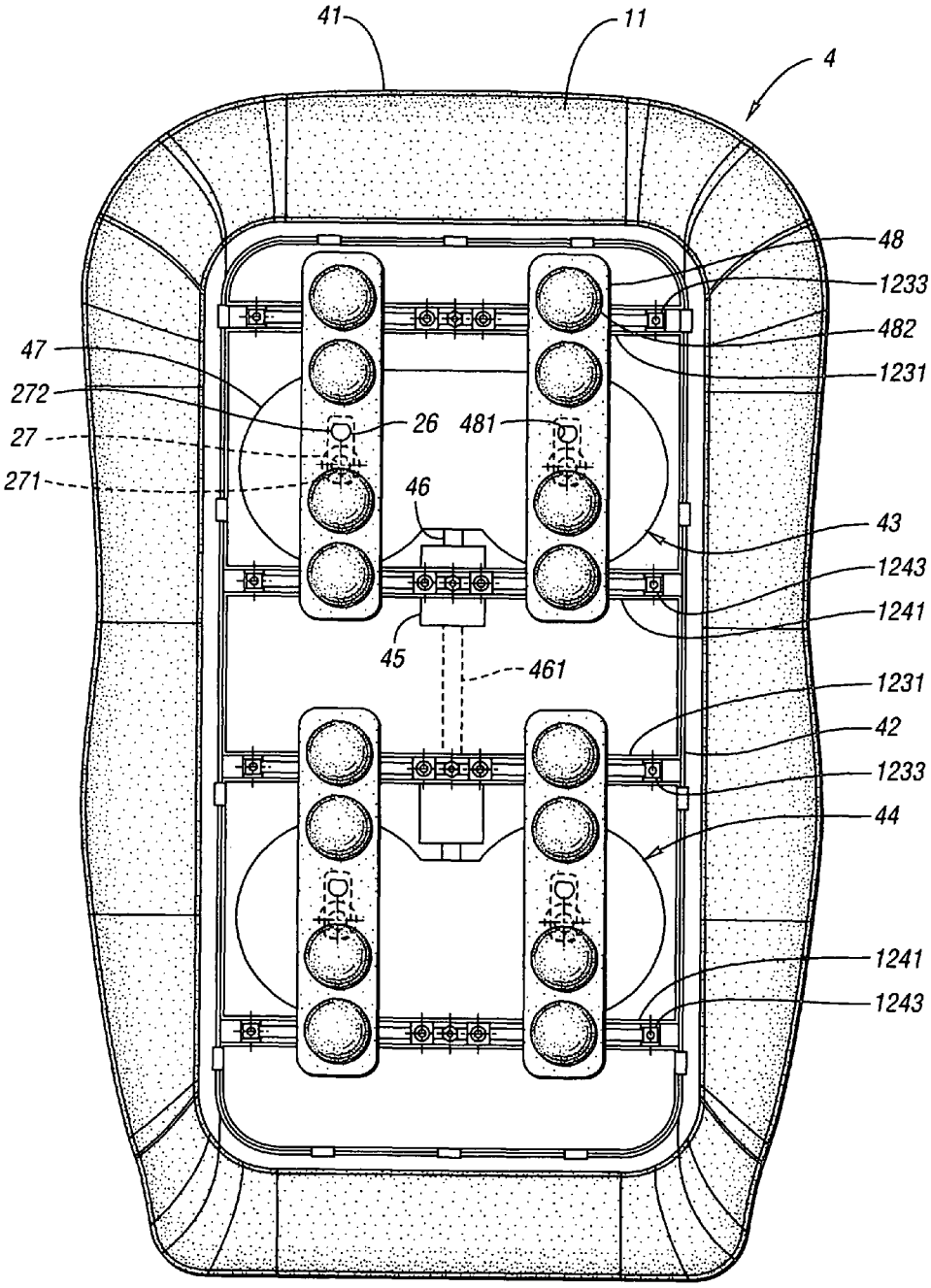
FIG. 7 is a fragmentary front elevation view of yet another body massage apparatus embodiment in accordance with the present invention.

Referring now to FIG. 7, a seat cushion back 4 is illustrated in accordance with the present invention. Similar or same elements retain same reference numerals, wherein new elements are assigned new reference numerals. The seat cushion back 4 includes a body 41 with a supporting frame 42. An upper massage mechanism 43 and a lower massage mechanism 44 are provided within the supporting frame 42 for imparting a massage effect upon an upper and lower region of the user, such as upper and lower regions of the back. Of course, the invention contemplates that multiple massage mechanisms may be employed for imparting the massage effect to multiple body portions; for example, three or more massage mechanisms may be provided for imparting massage effects to three or more body regions of the user.

Each of the upper and lower massage mechanisms 43, 44 includes a motor 45 mounted in the frame 42, for driving a rotary output shaft 46. Each rotary output shaft 46 extends into a gear cover 47. Similar to the prior embodiment, the shaft 46 drives a screw 24 (FIG. 3) for driving a pair of counter-rotating worm gears 23 (FIG. 3). Each worm gear 23 (FIG. 3) drives a transmission shaft 26, which extends through a bore 271 of an eccentric rotating block 27. Each eccentric rotating block 27 is provided with a bolt 272 that extends through a bore 481 of a massage member 48.

Each massage member 48 has a longitudinal length appropriate for providing a massage effect about the region of the massage mechanism 43, 44. The massage members 48 illustrated in FIG. 7, each include four hemispherical massage nodes 482 in a linear array that is bisected by the bore 481.

Figure 2:
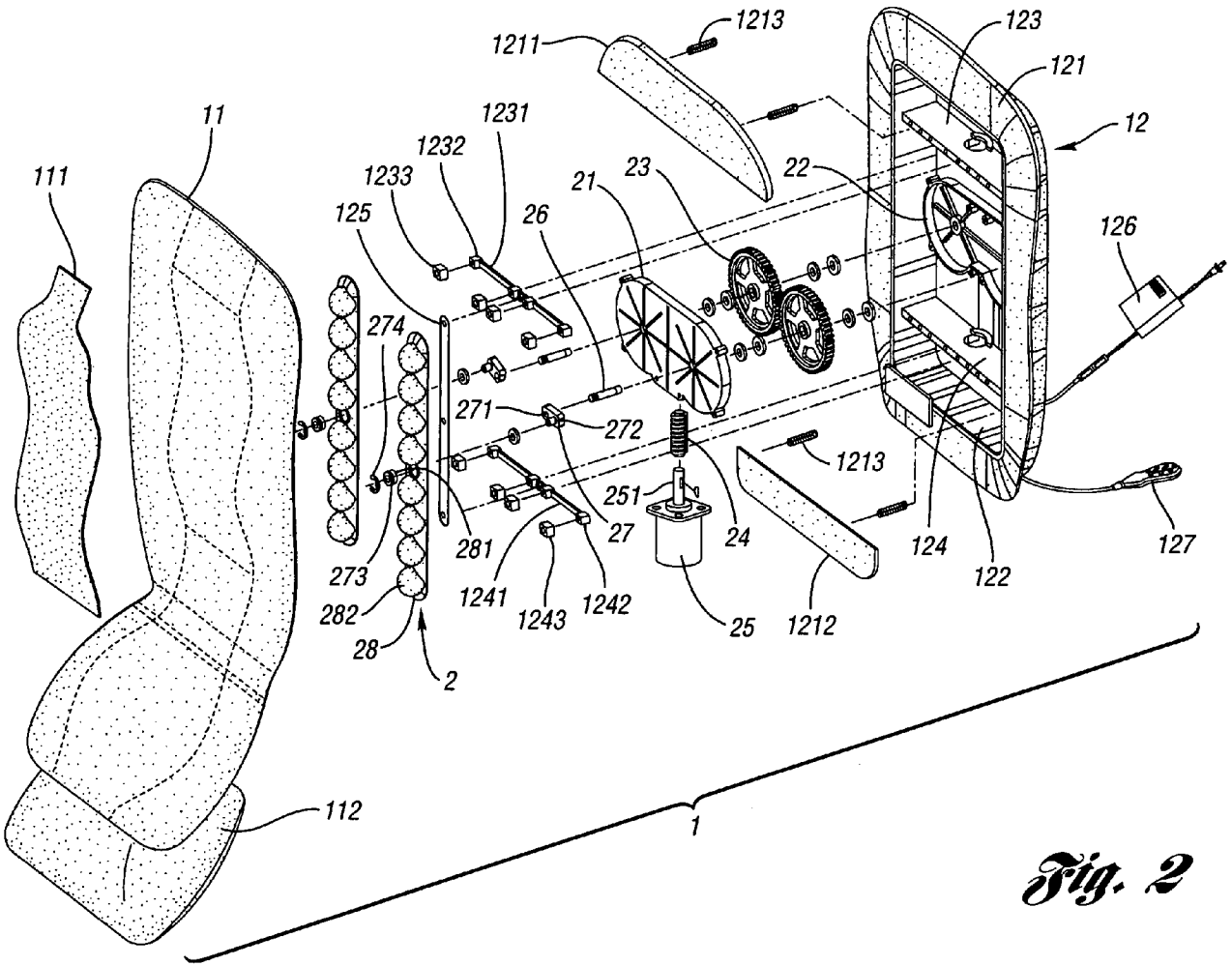
FIG. 2 is an exploded perspective view of the body massage apparatus of FIG. 1.

Each massage mechanism 43, 44 may be provided with an upper cross support 123 (FIG. 2) and a lower cross support (FIG. 2). An upper rail 1231 is provided on each upper cross support 123; and a lower rail 1241 is provided on each lower cross support 124 of the respective massage mechanisms 43, 44. Similar to the prior embodiments, each rail 1231, 1241 includes a series of apertures 1232, 1242 respectively, which each receive one of a series of padding blocks 1233, 1243, respectively. Similar to the prior embodiments, the padding blocks 1233, 1243 of the upper massage mechanism 43 bound the massage members 48 laterally during oscillation relative to the seat cushion back 4. Likewise, the padding blocks 1233, 1243 of the lower massage mechanism 44 bound the massage members 48 laterally during oscillation relative to the seat cushion back 4. Therefore, the massage effect may be imparted across the back of the user as illustrated in prior embodiments, or imparted to multiple portions of the body of the user. Additionally, the massage mechanisms 43, 44 may be driven at different speeds, in different directions, or alternating for providing the desired massage effect or combination of massage effects to the user.

Alternatively, the upper and lower massage mechanisms 43, 44 may be driven by a common motor, such as the motor 45 of the upper massage mechanism 43. The motor 45 may drive the first rotary output shaft 46 and a second rotary output shaft 461 (illustrated in phantom in FIG. 7), which may extend into the gear cover 47 of the lower massage mechanism 44 for driving the lower massage mechanism 44 simultaneously with the upper massage mechanism 43. Thus, the upper and lower massage mechanisms 43, 44 may be driven from the common motor 45, thereby reducing the weight, costs, and components of the seat cushion back 4.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A massage apparatus comprising:

a housing;

a motor oriented in the housing, the motor having a rotary output shaft;

an eccentric drive supported for rotation by the housing and operably driven by the motor output shaft for rotation relative to the housing; and a massage formation at least partially extending from the housing, the massage formation being operably driven by the eccentric drive for translation in a first linear direction relative to the housing, a second linear direction that is generally perpendicular to the first linear direction and rotationally relative the housing for imparting a massage effect upon a user, the massage formation cooperating with the housing such that the housing provides a limit to a range of translation of the massage formation within one of the first and second linear directions and the housing provides a limit to a range of rotational translation of the massage formation.

2. The massage apparatus of claim 1 further comprising a hard stop provided on the housing for engaging the massage formation and thereby limiting the range of translation of the massage formation within one of the first and second linear directions and limiting the range of rotational translation of the massage formation.

3. The massage apparatus of claim 1 further comprising an elastomeric pad provided on the housing for engaging the massage formation and thereby limiting the range of translation of the massage formation within one of the first and second linear directions and limiting the range of rotational translation of the massage formation.

4. The massage apparatus of claim 1 further comprising a pair of spaced apart hard stops provided on the housing and oriented with the massage formation displaced therebetween for engaging the massage formation and thereby limiting the range of translation of the massage formation within one of the first and second linear directions and limiting the range of rotational translation of the massage formation.

5. The massage apparatus of claim 1 further comprising:

a hard stop provided on the housing for engaging the massage formation and thereby limiting the range of translation of the massage formation within one of the first and second linear directions and limiting the range of rotational translation of the massage formation; and a contact member provided on the massage formation for contacting the hard stop.

6. The massage apparatus of claim 1 further comprising a second eccentric drive supported for rotation by the housing spaced apart from the first eccentric drive, the second eccentric drive being operably driven by the motor output shaft for rotation relative to the housing; and a second massage formation at least partially extending from the housing, the second massage formation being operably driven by the second eccentric drive for translation in the first and second linear directions relative to the housing, and for rotational translation relative the housing for imparting a massage effect upon a user, the second massage formation cooperating with the housing such that the housing provides a limit to a range of translation of the second massage formation within one of the first and second linear directions and the housing provides a limit to a range of rotational translation of the second massage formation.

7. The massage apparatus of claim 1 wherein the massage formation translates generally within a plane defined by the first and second linear directions and the massage formation translates rotationally about an axis that is generally perpendicular to the plane.

8. The massage apparatus of claim 1 further comprising a second massage formation at least partially extending from the housing, the second massage formation being spaced apart from the first massage formation in the other of the first and second directions for imparting a massage effect upon another region of the user.

9. The massage apparatus of claim 1 further comprising:

a second motor oriented in the housing, the second motor having a second rotary output shaft;

a second eccentric drive supported for rotation by the housing and operably driven by the second motor output shaft for rotation relative to the housing; and a second massage formation at least partially extending from the housing and spaced apart from the first massage formation, the second massage formation being operably driven by the eccentric drive for oscillation relative to the housing for imparting a massage effect upon the user.

10. The massage apparatus of claim 1 wherein the massage formation further comprises a plurality of massage nodes.

11. The massage apparatus of claim 1 wherein the housing is sized to be received and supported by a conventional chair.

12. The massage apparatus of claim 1 further comprising a worm drive mounted to the motor output shaft; and a worm gear rotationally mounted to the housing and driven by the worm drive for rotation relative to the housing, the worm drive being connected to the eccentric drive for rotationally driving the eccentric drive.

13. The massage apparatus of claim 12 further comprising:

a second worm gear spaced apart from the first worm gear, rotationally mounted to the housing and driven by the worm drive for rotation relative to the housing;

a second eccentric drive supported for rotation by the housing and driven by the second worm gear for rotation relative to the housing; and a second massage formation at least partially extending from the housing, the second massage formation being operably driven by the second eccentric drive for translation in the first and second linear directions and for rotational translation relative the housing for imparting a massage effect upon the user, the second massage formation cooperating with the housing such that the housing provides a limit to a range of translation of the second massage formation within one of the first and second linear directions and the housing provides a limit to a range of rotational translation of the second massage formation.

14. The massage apparatus of claim 1 wherein the massage formation further comprises a linear array of massage nodes.

15. The massage apparatus of claim 14 further comprising:

a first pair of transversely spaced apart elastomeric pads provided on the housing and oriented with the massage formation displaced therebetween; and a second pair of transversely spaced elastomeric pads provided on the housing and spaced longitudinally from the first pair of elastomeric pads, such that the first and second pairs of elastomeric pads engages transverse sides of the massage formation and thereby limit the range of translation of the massage formation within one of the first and second linear directions and limit the range of rotational translation of the massage formation.

16. The massage apparatus of claim 14 wherein the massage formation is pivotally connected to the eccentric drive at an orientation that generally bisects the linear array of massage nodes.

17. The massage apparatus of claim 14 further comprising at least one slide support provided within the housing beneath the massage formation and spaced apart from the eccentric drive for supporting an underside of the massage formation during the application of a body part of the user and for permitting the massage formation to slide along the slide support as the massage formation is translated relative to the housing.

18. The massage apparatus of claim 17 further comprising at least one slide block mounted to the underside of the massage formation at an orientation to engage the slide support during the application of the body part of the user for reducing friction between the massage formation and the slide support.

19. A massage cushion comprising:

a seat cushion having an L-shaped fabric cover and a seat cushion back with a concave body;

a massage mechanism disposed inside said seat cushion, said massage mechanism including:

a gear cover constructed by a front gear cover and a back gear cover, two gears installed at the right and the left inside said gear cover, a screw located between said two gears, a driving motor fixed at the bottom of said screw so that the gears can be driven by the driving motor via the screw, two elongate massage members, each equipped with a plurality of ball-shaped massage heads for effecting massage on a user, two transmission shafts, each disposed along the axis of each of said gears, and each of said transmission shafts passing through the front gear cover, two eccentric rotating blocks, each having a bore through which one of said transmission shafts passes, and two bolts, each fixed on the eccentric rotating block and passing through a bore of one of the elongate massage members;

a fabric flap disposed on the front of said fabric cover for damping the force on the users by the massage heads;

a sponge body attached at the bottom of the lower part of said fabric cover;

a supporting frame installed inside said concave body:

an upper cross support located at an upper position of said supporting frame;

an upper rail having a plurality of apertures, disposed on the front of said upper cross support;

a padding block provided for each of said upper rail apertures;

a lower cross support disposed at a lower position of said supporting frame;

a lower rail having a plurality of apertures, disposed on the front of said lower cross support;

a padding block provided for each of said lower rail apertures;

a longitudinal support disposed between said upper rail and said lower rail for fixing the front gear cover in position;

a power cord in cooperation with said massage mechanism; and a controller in cooperation with said massage mechanism.

20. A massage apparatus comprising:

a housing;

a motor oriented in the housing, the motor having a rotary output shaft;

an eccentric drive supported for rotation about a first axis by the housing and operably driven by the motor output shaft for rotation relative to the housing; and a massage formation at least partially extending from the housing, the massage formation being supported for rotation by the eccentric drive about a second axis offset from the first axis such that the massage formation revolves about the first axis as the eccentric drive is driven.

21. The massage apparatus of claim 20 wherein the massage formation operably cooperates with the housing to limit rotation of the massage formation about the second axis.

22. The massage apparatus of claim 1 wherein the eccentric drive is supported for rotation about a first axis by the housing; and wherein the massage formation is supported for rotation by the eccentric drive about a second axis offset from the first axis such that the massage formation revolves about the first axis as the eccentric drive is driven.

* * * * *